US009539852B2

(12) United States Patent
Maxik et al.

(10) Patent No.: US 9,539,852 B2
(45) Date of Patent: Jan. 10, 2017

(54) LIGHTING SYSTEM FOR ACCENTING REGIONS OF A LAYER AND ASSOCIATED METHODS

(71) Applicant: Lighting Science Group Corporation, Melbourne, FL (US)

(72) Inventors: Fredric S. Maxik, Cocoa Beach, FL (US); David E. Bartine, Cocoa, FL (US); Robert R. Soler, Cocoa Beach, FL (US); Mark Andrew Oostdyk, Cape Canaveral, FL (US); Matthew Regan, Melbourne, FL (US); Addy S. Widjaja, Palm Bay, FL (US); Mark Penley Boomgaarden, Satellite Beach, FL (US); Eliza Katar Grove, Satellite Beach, FL (US)

(73) Assignee: Lighting Science Group Corporation, Cocoa Beach, FL (US)

( * ) Notice: Subject to any disclaimer, the term of this patent is extended or adjusted under 35 U.S.C. 154(b) by 0 days.

(21) Appl. No.: 14/921,360

(22) Filed: Oct. 23, 2015

(65) Prior Publication Data

US 2016/0040842 A1 Feb. 11, 2016

Related U.S. Application Data

(63) Continuation-in-part of application No. 14/275,371, filed on May 12, 2014, now Pat. No. 9,173,269, which is a continuation-in-part of application No. 13/709,942, filed on Dec. 10, 2012, now Pat. No. 8,760,370, which is a continuation-in-part of (Continued)

(51) Int. Cl.

| | |
|---|---|
| ***B44F 1/08*** | (2006.01) |
| ***B44F 1/00*** | (2006.01) |
| ***H05B 33/08*** | (2006.01) |
| *H05B 37/02* | (2006.01) |

(52) U.S. Cl.

CPC ..... *B44F 1/00* (2013.01); *H05B 33/086* (2013.01); *H05B 33/0869* (2013.01); *H05B 37/029* (2013.01)

(58) Field of Classification Search

CPC ..... F21S 10/00; F21W 2121/00; B44F 1/00; H05B 33/086; H05B 33/0869; H05B 37/029

See application file for complete search history.

(56) References Cited

U.S. PATENT DOCUMENTS

2008/0291671 A1* 11/2008 Lei ..... B44C 5/005 362/231
2010/0084992 A1* 4/2010 Valois ..... H05B 37/0254 315/291

* cited by examiner

*Primary Examiner* — Bao Q Truong
*Assistant Examiner* — Nathaniel Lee
(74) *Attorney, Agent, or Firm* — Mark Malek; Daniel Pierron; Widerman Malek, PL

(57) ABSTRACT

A system for accenting an appliqué comprising a lighting system comprising a light source configured to emit polychromatic light, and an appliqué configured to be applied to a surface, the appliqué being configured to at least one of scatter light and reflect light within an appliqué wavelength range. The light source is operable to emit alternating first and second polychromatic lights, the first polychromatic light comprising a maxima within the appliqué wavelength range and the second polychromatic light not comprising a maxima within the appliqué wavelength range.

18 Claims, 4 Drawing Sheets

Related U.S. Application Data application No. 13/107,928, filed on May 15, 2011, now Pat. No. 8,547,391, and a continuation-in-part of application No. 13/234,371, filed on Sep. 16, 2011, now Pat. No. 8,465,167.

(60) Provisional application No. 61/643,308, filed on May 6, 2012, provisional application No. 61/643,316, filed on May 6, 2012.

LIGHTING SYSTEM FOR ACCENTING REGIONS OF A LAYER AND ASSOCIATED METHODS

RELATED APPLICATIONS

This application is a continuation-in-part of U.S. patent application Ser. No. 14/275,371 titled Lighting System for Accentuating Regions of a Layer and Associated Methods filed May 12, 2014, which in turn is a continuation-in-part of U.S. patent application Ser. No. 13/709,942, now U.S. Pat. No. 8,760,370 titled System for Generating Non-Homogenous Light and Associated Methods filed Dec. 10, 2012, which is, in turn, related to and claims the benefit of U.S. Provisional Patent Application Ser. No. 61/643,308 titled Tunable Light System and Associated Methods filed May 6, 2012, U.S. Provisional Patent Application Ser. No. 61/643,316 titled Luminaire Having an Adaptable Light Source and Associated Methods filed May 6, 2012, and is a continuation-in-part of U.S. patent application Ser. No. 13/107,928, now U.S. Pat. No. 8,547,391 titled High Efficacy Lighting Signal Converter and Associated Methods filed May 15, 2011, and U.S. patent application Ser. No. 13/234,371, now U.S. Pat. No. 8,465,167 titled Color Conversion Occlusion and Associated Methods filed Sep. 16, 2011, the contents of each of which are incorporated in their entirety herein except to the extent disclosure therein is inconsistent with disclosure herein.

FIELD OF THE INVENTION

The present invention relates to lighting systems that selectively emit light containing maxima within specific wavelength ranges and appliqués responsive to the emitted light, and associated methods.

BACKGROUND OF THE INVENTION

Making a picture, character, or otherwise identifiable image appear on a surface has usually involved the projection of the image on an otherwise blank surface. Moreover, the progression of a sequence of images, such as simulating motion, has tended to include either a series of projecting devices working in sequence to project the images, or a single projecting device that moves or rotates. However, such systems typically require the environment in which the image is to be perceived to be relatively darker, or the image may be difficult to perceive. Moreover, the projection of an image onto a non-blank surface makes the image difficult to recognize.

Images have been embedded in random, pseudo-random, or otherwise non-recognizable patterns. This is useful for entertainment, where an image becomes apparent where it once was not apparent. For example, autostereograms are well known. However, prior embedded images have typically relied on biological responses, such as the decoupling of eye convergence, in order for the embedded image to become apparent, and not all observers are able to accomplish such decoupling. Other systems rely on a filter to be positioned intermediate the embedded image and the observer, usually in the form of eyewear. These systems are generally undesirable, as the eyewear is not conducive to ordinary activities. Accordingly, there is a need for a system for eliciting embedded images without impeding the activity of the observer, and that is readily observable by all observers.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a system for accenting an appliqué comprising a lighting system comprising a light source configured to emit polychromatic light and an appliqué configured to be applied to a surface, the appliqué being configured to at least one of scatter light and reflect light within an appliqué wavelength range. The light source may be operable to emit alternating first and second polychromatic lights, the first polychromatic light comprising a maxima within the appliqué wavelength range and the second polychromatic light not comprising a maxima within the appliqué wavelength range.

The appliqué may be configured to absorb light within the visible light spectrum outside the appliqué wavelength range. Additionally, the appliqué may be a sheet of material configured to be applied to the surface.

In some embodiments, the light source may comprise a plurality of light-emitting diodes. Furthermore, each of the first polychromatic light and the second polychromatic light may be a white light. Additionally, the first polychromatic light and the second polychromatic light may be within a two-step MacAdam ellipse of each other.

In some embodiments, the light source may be configured to be operably coupled to a computerized device. Additionally, light source may be configured to be operated by the computerized device so as to emit one of the first polychromatic light and the second polychromatic light. The light source may comprise a network communication device configured to communicate with the computerized device across a network. The network may be at least one of a Personal Area Network, a Local Area Network, and a Wide Area Network, including the Internet. Additionally, the computerized device may be selected from the group consisting of a smartphone, a tablet, a personal computer, and a server.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Figure 1:
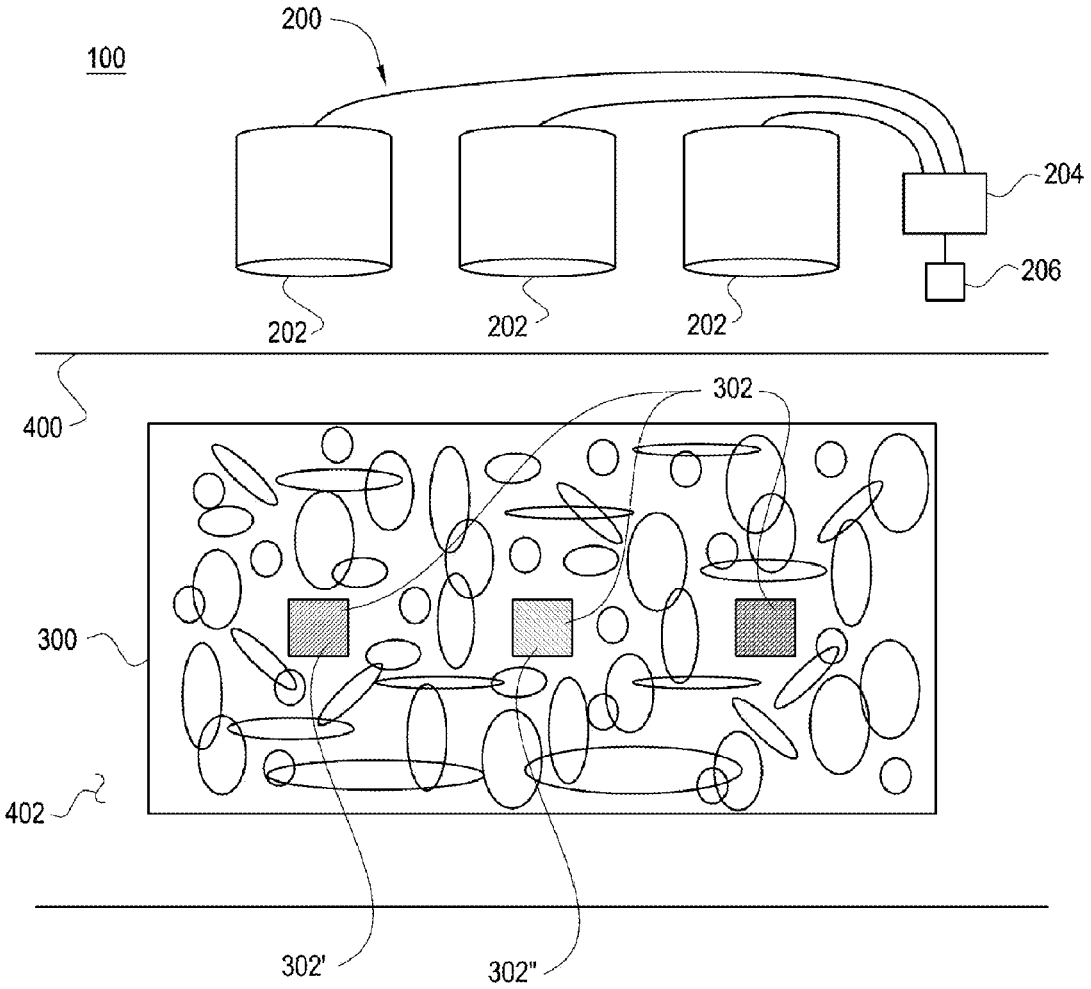
FIG. 1 is a side elevation view of a lighting system and surface according to an embodiment of the invention.

An embodiment of the invention, as shown and described by the various figures and accompanying text, provides a system 100 comprising a lighting system 200 and a layer 300, as shown in FIG. 1. The lighting system 200 may be configured to emit light having certain characteristics of light that interact with certain regions 302 of the layer 300 to accent those regions.

The lighting system 200 may comprise a plurality of light sources 202. The plurality of light sources 202 may each be a light-emitting device configured to emit light having certain light characteristics. Examples of light characteristics that may be controlled in the emission of light include wavelength, luminous intensity, color, and color temperature. Moreover, each light source 202 may be configured to emit monochromatic light or polychromatic light. Additionally, the plurality of light sources 202 may include a type of light source, including, but not limited to, an incandescent source, a fluorescent source, a light-emitting semiconductor such as a light-emitting diode (LED), a halogen source, an arc source, or any other light source known in the art. More information regarding the operation and characteristics of the plurality of light sources 202 may be found in U.S. patent application Ser. No. 13/709,942, the entire contents of which is incorporated by reference hereinabove.

Continuing to refer to FIG. 1, the layer 300 will now be discussed in greater detail. The layer 300 may be a layer of material configured to be applied to the surface 402 of a structure 400. Furthermore, the layer 300 may include one or more regions 302 that are configured to interact with light emitted by the lighting system 200 so as to be accented. In some embodiments, the layer 300 may comprise a first region 302' and a second region 302". The first region 302' may be configured to have a first surface scatter profile. More specifically, the first region 302' may be configured to reflect, scatter, diffusely reflect, diffusively scatter, or otherwise redirect light within a scattering wavelength range and absorb light outside the scattering wavelength range. Furthermore, the first region 302' may be configured to reflect, scatter, diffusely reflect, or otherwise redirect light having a certain scattering wavelength and absorb light having a different wavelength. The scattering wavelength range and the scattering wavelength may be associated with a color. Similarly, the second region 302" may have a second surface scatter profile that is configured to reflect, scatter, diffusely reflect, or otherwise redirect light within a certain scattering wavelength range and absorb light outside the scattering wavelength range, or reflect, scatter, diffusely reflect, or otherwise redirect light having a certain scattering wavelength and absorb light having a different wavelength. The scattering wavelength range and scattering wavelength may be associated with a color. Additionally, the first surface scatter profile may be configured to reflect, scatter, diffusely reflect, or otherwise redirect light associated with a color that is also the same as or similar to the color of light that the second surface scatter profile is configured to reflect, scatter, diffusely reflect, or otherwise redirect, or it may be of a different color.

The first region 302' and the second region 302" may be positioned anywhere on the layer 300. In some embodiments, the first region 302' may be positioned at some distance from the second region 302". In some embodiments, the first region 302' and the second region 302" may be relatively near to each other. The distance between each of the first region 302' and the second region 302" may be configured based upon the entire length of the surface 402, the sizes of each of the first region 302' and the second region 302", the number of any other regions 302 apart from the first and second regions 302', 302", or any other configuration. Additionally, the distance between the first and second regions 302', 302" may be determined based on a center-to-center determination or an edge-to-edge determination. The above configurations are exemplary only and do not limit the scope of the invention.

Additionally, each of the first region 302' and the second region 302" may be configured into a desired shape. In some embodiments, each of the first and second regions 302', 302" may be shaped into a representation of a recognizable object, character, ideogram, numeral, or image. In some embodiments, the first region 302' may be shaped into a representation a first object, character, ideogram, numeral, or image in a sequence, and the second region 302' may be shaped into a representation of a second object, character, ideogram, numeral, or image in the sequence. It is appreciated that any number of regions 302 may be configured to represent any number of items in a sequence.

The regions 302 may be formed into the layer 300 by any suitable means, methods, or process. In some embodiments, the layer 300 may include a base material 304, and each of the regions 302 are topically attached to a surface 306 of the base material. Examples of topical attachment including painting, adhesives, glues, transfers, appliqués, static cling, magnetism, and any other method of topical attachment are included within the scope of the invention.

In some embodiments, the regions 302 may be configured to have a first section configured to diffusively scatter light within the scatter wavelength range as described herein above, and a second section configured to absorb light within the scatter wavelength range. For example, in some embodiments, a perimeter of the regions 302 may be configured to absorb light within the scatter wavelength range and an interior of the regions 302 may be configured to diffusively scatter light within the scatter wavelength range. In other embodiments, an interior section of the regions 302 may be configured to absorb light within the scatter wavelength range, and the section of the regions 302 surrounding the interior section may be configured to diffusively scatter light within the scatter wavelength range.

The layer 300 may be any material and of any form that may be applied and attached to a surface of a structure, either fixedly or temporarily. Examples of such forms include, without limitations, paints, sheets of material such as wallpaper, wall coverings, structural wall features, and any other forms known in the art.

The lighting system 200 may be configured to include a plurality of light sources 202 that are capable of emitting light falling within the scatter wavelength ranges of each of the first surface scatter profile and the second surface scatter profile. In some embodiments, the light emitting elements of the plurality of light sources 202 may be configured to generate polychromatic light having varying spectral power distributions. In other embodiments, the plurality of light sources 202 may emit light, either monochromatic or polychromatic, that combines to form a combined polychromatic light. In either of these embodiments, the polychromatic light may include within its spectral power distribution light within a wavelength range corresponding to a scatter wavelength range associated with one of the first surface scatter profile and the second surface scatter profile, or both. Furthermore, the polychromatic light may be perceived as a white light by an observer.

In some embodiments, the plurality of light sources 202 may be positioned in an array, the array being positionable adjacent to a ceiling. In such embodiments, the layer 300 may be attached to a surface of a wall such that light emitted by the plurality of light sources 202 is incident upon the layer 300.

When the polychromatic light is incident upon the first region 302' and the second region 302", each of the wavelengths included within the spectral power distribution of the polychromatic light will be either absorbed or reflected, scattered, diffusely reflected, or otherwise redirected by each of the regions. More specifically, when the polychromatic light includes a wavelength within a scatter wavelength range associated with one of the first region 302' or the second region 302", or both, the associated scatter wavelength range will be scattered, while the remainder of the spectral power distribution will be absorbed. Accordingly, the light within the scatter wavelength range will be reflected, scattered, diffusely reflected, or otherwise redirected into the environment and observable. Moreover, where the region 302 that is scattering the light is shaped to represent an object, character, ideogram, numeral, or image, that representation will similarly be observable. Correspondingly, when the spectral power distribution of the polychromatic light does not include light within a scatter wavelength range associated with the first region 302' or the second region 302", the regions 302 will absorb approximately the entire spectral power distribution, no light will be scattered, and the regions will be generally less noticeable.

It is appreciated that in a spectral power distribution, lower levels of light within the scatter wavelength ranges associated with each of the regions 302 may be present, even when not intentionally emitted by the lighting system 200. Accordingly, where the lighting system 200 causes the plurality of lighting devices 202 to emit polychromatic light having a peak within its spectral power distribution within a scatter wavelength range associated with one of the first region 302' or the second region 302', or both, the region 302 with that scatter wavelength range will be generally more apparent, noticeable, and accented than when the spectral power distribution does not include such a peak, but does still include a relatively lower level of light within the scatter wavelength range.

In some embodiments, the lighting system 200 may include a controller 204 configured to selectively operate the plurality of light sources 202. Furthermore, the controller 204 may be configured to operate the plurality of light sources 202 so as to selectively emit light having a wavelength within the scatter wavelength range of one of the first region 302' or the second region 302", or both. Furthermore, the controller 204 may be configured to operate the plurality of light sources 202 to emit a first polychromatic light including within its spectral power distribution a wavelength within a wavelength range associated with the first region 302', and a second polychromatic light including within its spectral power distribution a wavelength within a wavelength range associated with the second region 302". In this way, the controller 204 may selectively make more prominent to an observer the first region 302', the second region 302", or both, by causing the plurality of light sources 202 to emit a polychromatic light to include a wavelength within the respective scatter wavelength ranges.

In some embodiments, the lighting system 200 may further include a memory 206 in electronic communication with the controller 204. The memory 206 may contain an electronic file that is accessible and readable by the controller 204. The electronic file may include one or more instructions that may be read by the controller 204 that may then cause the controller 204 to operate the plurality of light sources 202 in accordance with the instructions. The instructions may include commands to operate one or more of the plurality of light sources 202 to emit polychromatic light such that the spectral power distribution of the polychromatic light includes or excludes light within a wavelength range associated with a scatter wavelength range of one or both of the first region 302' and the second region 302". Moreover, the instructions may provide a sequence of commands to thusly operate one or more of the plurality of light sources 202 so as to accent and make more noticeable the sequence represented in the first and second regions 302', 302". For example, the instructions may include a sequence of wavelengths to be emitted including a first wavelength and a second wavelength. The controller 204 may then determine a first polychromatic light comprising a plurality of wavelengths to be emitted by the plurality of light sources 302 including the first wavelength and excluding the second wavelength. The controller 204 may then operate the plurality of light sources 302 to emit the first polychromatic light. The controller 204 may then determine a second polychromatic light comprising a plurality of wavelengths including the second wavelength and excluding the first wavelength. The controller 204 may then operate the plurality of light sources 302 to emit the second polychromatic light. It is appreciated that the instructions may contain any number of wavelengths in a sequence, and a corresponding number of polychromatic lights including one or more of the wavelengths in the sequence may be determined by the controller 204.

In some embodiments, where one or both of the regions 302 are shaped to represent an object, character, ideogram, numeral, or image, when the polychromatic light includes light within the scatter wavelength range of that region 302, the represented object, character, ideogram, numeral, or image will become highlighted, more apparent, noticeable, and accented. As a result, an observer will be more likely to observe and recognize the object, character, ideogram, numeral, or image when the polychromatic light includes light within the scatter wavelength range. Moreover, where the regions 302 include sequential representations, the sequence of those images may similarly be observable.

Figure 2:
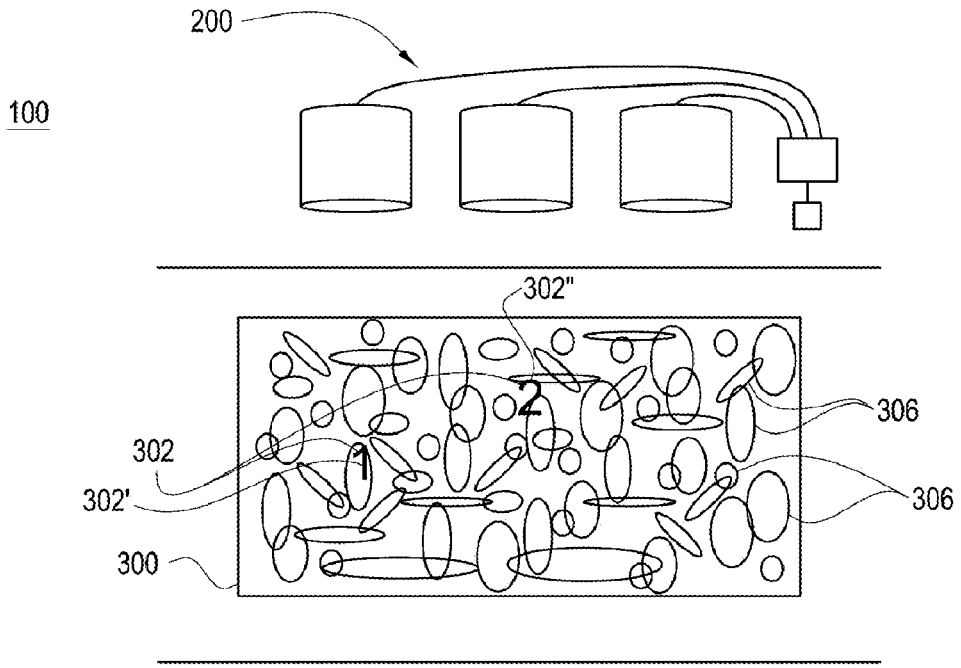
FIG. 2 is a side elevation view of an alternative embodiment of the invention.

For example, referring now to FIG. 2, the first region 302' may be configured into the shape of a numeral, for example, the number 1. Similarly, the second region 302" may be configured into the shape of another numeral, such as the sequential number 2. When the polychromatic light includes within its spectral power distribution a wavelength within the scatter wavelength range associated with the first region 301', the first region 301' will be more prominent to an observer. Accordingly, the number 1 will be more prominent to an observer. Furthermore, if the polychromatic light also includes light within its spectral power distribution a wavelength within the scatter wavelength range associated with the second region 302", the second region 302" will similarly be more prominent, and an observer may more readily see the number 2. The polychromatic light may include both wavelengths associated with the scatter wavelength ranges of the respective regions 302 simultaneously, or it may include them successive or otherwise sequential polychromatic lights, requiring the polychromatic light to vary with time. In this way, any type of sequence, be it a sequence of numbers, letters to form a word, or sequences of images to simulate motion, may be made more prominent across the layer 300.

Furthermore, it is appreciated that the regions 302 may be positioned such that the sequence may be oriented to proceed in any direction across the layer 300. For example, the regions 302 may be positioned such that the sequence progresses laterally, vertically, or in any other geometric configuration, such as a sinusoidal wave, stair-step, a circle, and any other orientation. This list is exemplary only and does not limit the scope of the invention.

In some embodiments, the layer 300 may further include non-accented regions 306 positioned on the layer 300 generally surrounding the regions 302. The non-accented regions 306 may be configured to facilitate the making more prominent and noticeable the regions 302 when the associated scatter light wavelength is incident thereupon. Moreover, the non-accented regions 306 may be configured to make the regions 302 generally less prominent or noticeable when the associated scatter light wavelength is not present. The non-accented regions 306 may be generally amorphous, random, pseudo-random, or otherwise not recognizable by an observer to be recognizable as an object, character, ideogram, numeral, or image.

Figure 3:
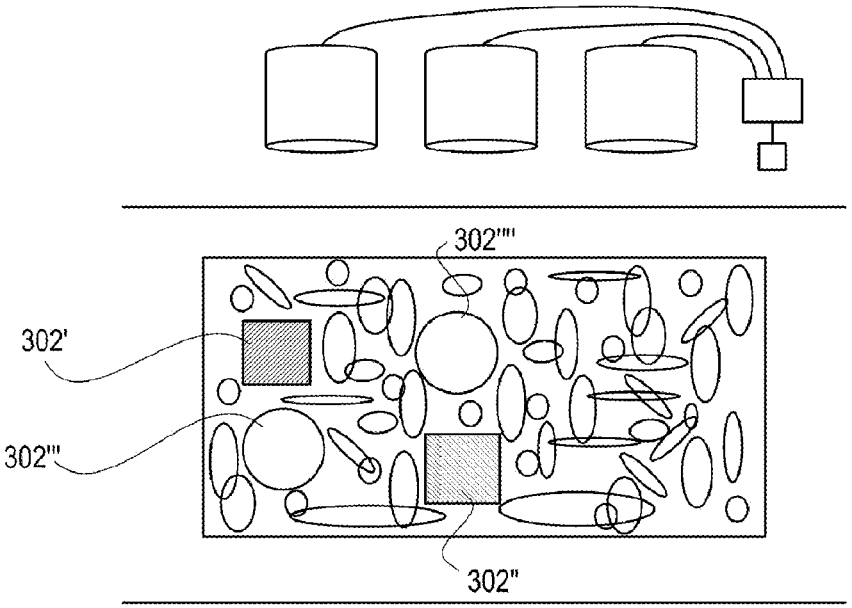
FIG. 3 is a side elevation view of an alternative embodiment of the invention.

Referring now to FIG. 3, another embodiment of the present invention is depicted. In this embodiment, the layer 300 includes a plurality of regions 302, namely a first region 302', a second region 302" and third region 302''', and a fourth region 302''''. Similar to the regions described above, the regions 302', 302", 302''', 302'''' of FIG. 3 may each have an associated surface scatter profile configured to reflect, scatter, diffusively reflect, or otherwise redirect light incident thereupon that is within a scatter wavelength range or is a scatter wavelength. All light having a wavelength outside the scatter wavelength range or that is different from the scatter wavelength are absorbed.

The third region 302''' may be generally adjacent the first region 302', and the fourth region 302'''' may be generally adjacent the second region 302". Additionally, the third region 302''' may have a surface scatter profile that is configured to scatter light within a scatter wavelength range that is about the same as a scatter wavelength range of the first region 302', or it may be different from the scatter wavelength range of the first region 302'. Similarly, the fourth region 302'''' may have a surface scatter profile that is configured to scatter light within a scatter wavelength range that is about the same as a scatter wavelength range of the second region 302", or it may be different from the scatter wavelength range of the second region 302". Where the first and third regions 302', 302''' have scatter wavelength ranges that are about the same, when light within that range is present, due to their close proximity, both the first region 302' and the third region 302''' will scatter the light as described above and become accented or otherwise more prominent. Where the first and third regions 302', 302''' have scatter wavelength ranges that are different, one or both of the first and third regions 302', 302''' may be made more prominent by a polychromatic light containing a wavelength within the scatter wavelength range of one or both of the first and third regions 302', 302''', i.e. one polychromatic light may include a wavelength within the scatter wavelength range of one of the first and third regions 302', 302''', and a second polychromatic light may include two wavelengths, one within the scatter wavelength range of the first region 302', and the other within the scatter wavelength range of the third region 302'''. Accordingly, the first and third regions 302', 302''' may be selectively accented. The same may be accomplished with the second and fourth regions 302", 302''''.

Figure 4:
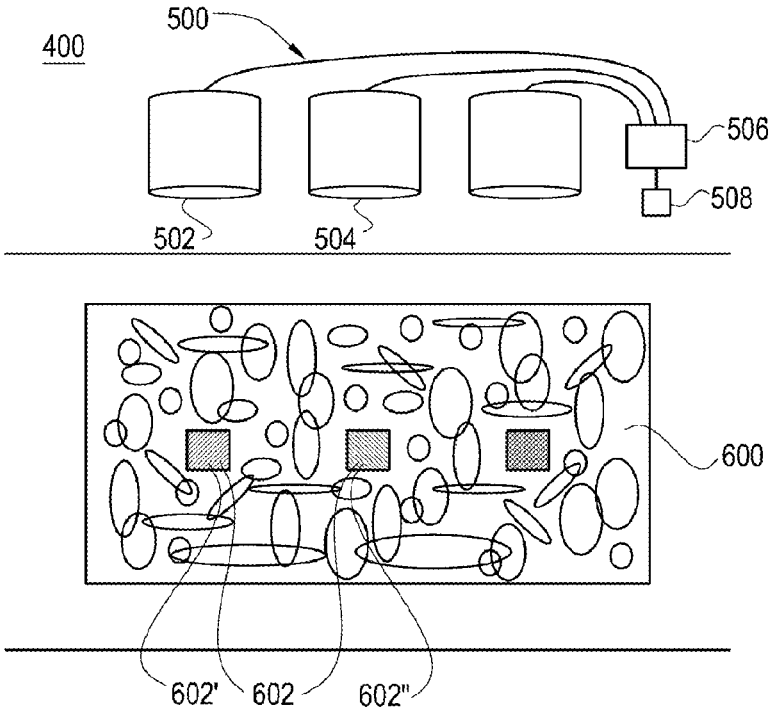
FIG. 4 is a side elevation view of the lighting system and surface of FIG. 1.

Referring now to FIG. 4, an additional embodiment of present invention is depicted. The present embodiment may include a system 400 comprising a lighting system 500 and a layer 600, substantially as described for the embodiment depicted in FIGS. 1-4. However, in the present, the layer 600 includes regions 602, namely a first region 602' and a second region 602", which are configured to have approximately identical surface scatter profiles that are configured to scatter light within a scatter wavelength range. Additionally, the first region 602' and the second region 602" may be positioned on the layer 600 so as to be spaced apart.

Still referring to FIG. 4, the lighting system 500 may include a first light source 502 and a second light source 504. The first light source 502 may be positioned such that light emitted by the first light source 502 is incident upon the first region 602' but is not incident upon the second region 602". Similarly, the second light source 504 may be positioned such that light emitted thereby is incident upon the second region 602" but not upon the first region 602'. The lighting system 500 may further include a controller 506 configured to selectively operate each of the first light source 502 and the second light source 504 independently of each other. Furthermore the controller 506 may be configured to operate each of the first and second light sources 502, 504 to emit polychromatic light. Yet further, the controller 506 may be configured to operate each of the first and second light sources 502, 504 such that, in a first instance, the first light source 502 emits a polychromatic light having a spectral power distribution including a wavelength within the scatter wavelength range of the first and second regions 602', 602", and the second light source 504 emits a polychromatic light having a spectral power distribution not including a wavelength within the scatter wavelength range of the first and second regions 602', 602". Because light emitted by the first light source 502 is incident upon the first region 602' and not the second region 602", only the first region 602' scatters the lighting within the scatter wavelength range and, hence, is made more prominent or noticeable.

Furthermore, the controller 506 may be configured to operate each of the first and second light sources 502, 504 such that, in a second instance, the first light source 502 emits a polychromatic light having a spectral power distribution not including a wavelength within the scatter wavelength range of the first and second regions 602', 602", and the second light source 504 emits a polychromatic light having a spectral power distribution including a wavelength within the scatter wavelength range of the first and second regions 602', 602". Because light emitted by the second light source 502 is incident upon the second region 602" and not the first region 602', only the second region 602" scatters the lighting within the scatter wavelength range and, hence, is made more prominent or noticeable.

The lighting system 500 may further include a memory 508 substantially as described above. The memory 508 may include instructions that are readable by the controller 506 that may include a sequence of wavelengths that may be used by the controller 506 to generate a sequence of polychromatic lights including one or more of the sequence of wavelengths that may be scattered by one or more of the regions 602.

Figure 5:
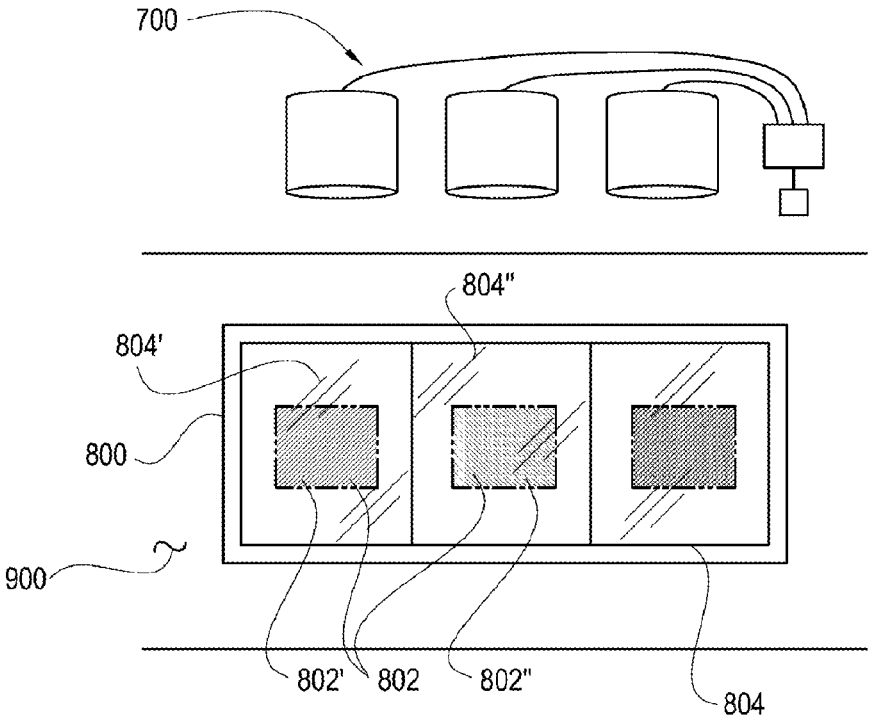
FIG. 5 is a side elevation view of a surface according to an alternative embodiment of the invention.

Referring now to FIG. 5, another embodiment of the present invention is now depicted. Some embodiments may include a lighting system 700 and a layer 800. The lighting system 700 may be substantially as described above, including a plurality of light sources 702 capable of emitting polychromatic light and a controller 704 coupled to each of the plurality of light sources 702 so as to control their emission.

The layer 800 may include one or more appliqués 802 attached to a surface 900. The appliqués 802 may be functionally similar to the regions 302, 602, described hereinabove, namely, have a scatter profile configured to diffusively scatter light within a scatter wavelength range and absorb light outside the scatter wavelength range. Similar to above, the appliqués 802 may be configured to wave scatter wavelength ranges that are approximately the same or are different. In some embodiments, the layer 800 may include a first appliqué 802' and a second appliqué 802". Additionally, the surface 900 may be configured to absorb light within the scatter wavelength range.

The appliqués 802 may be configured into a shape as described hereinabove for the regions 302, 602. Additionally, the appliqués 802 may be configured into shapes corresponding to a sequence or series. Furthermore, the appliqués 802 may be positioned about the layer 800 in any geometric configuration, as described hereinabove.

The layer 800 may further include a cover layer 804. The cover layer 804 may be positioned so as to generally cover the surface 900 and the appliqués 802. Where the cover layer 804 is so positioned, in order for any light to be incident upon the appliqués 802, it must traverse through the cover layer 804. Accordingly, the cover layer 804 may be configured to be transparent, translucent, or otherwise permit the traversal of light therethrough. In some embodiments, the cover layer 804 may be transparent to the entire spectrum of light. In some embodiments, the cover layer 804 may be transparent to only a portion of the spectrum of light, such as, for example, the visible spectrum, the infrared spectrum, and the ultraviolet spectrum. Furthermore, in some embodiments, the cover layer 804 may be configured to be transparent to a portion of the visible spectrum. In some embodiments, the cover layer 804 may be transparent to one or more portions of the visible spectrum corresponding to one or more scatter wavelength spectrums associated with the appliqués 802. For example, if the first appliqué 802' and the second appliqué 802" have scatter wavelength spectrums that are approximately equal, the cover layer 804 may be transparent to light within the scatter wavelength spectrum. As another example, where the first appliqué 802' has a scatter wavelength range that is different from that of the second appliqué 802", the cover layer 804 may be transparent to light within the scatter wavelength ranges of each of the first appliqué 802' and the second appliqué 802".

Moreover, in some embodiments, the cover layer 804 may include a first section 804' associated with and positioned so as to generally cover the first appliqué 802' and a second section 804" associated with and positioned so as to generally cover the second appliqué 802". The first section 804' may be configured to be generally transparent to light within a wavelength range corresponding to the scatter wavelength range of the first appliqué 802', and the second section 804" may be configured to be generally transparent to light within a wavelength range corresponding to the scatter wavelength range of the second appliqué 802".

Figure 6:
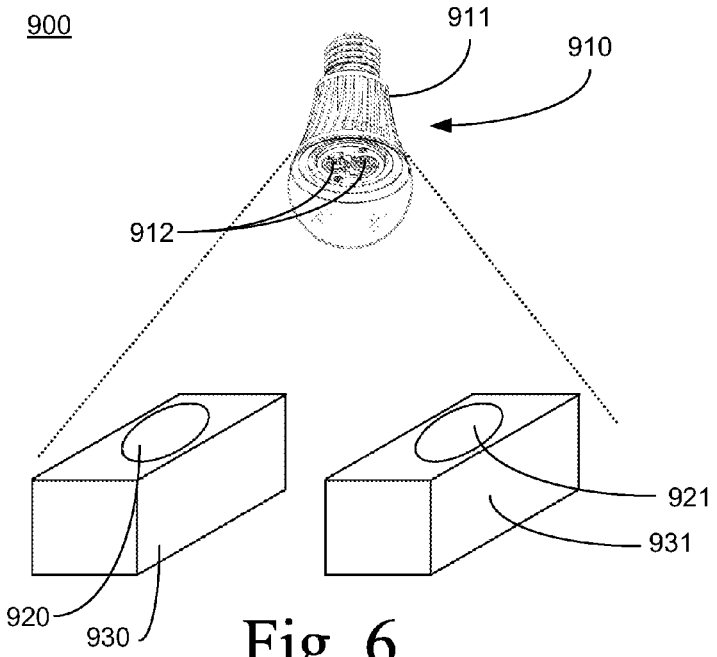
FIG. 6 is an environmental view of a system according to an embodiment of the invention.

Referring now to FIG. 6, a system 900 according to another embodiment of the invention is presented. The system 900 may comprise a lighting system 910 and at least one appliqué 920. The appliqué 920 may be configured to be applied to any surface, including surfaces of small objects. In some embodiments, the appliqué 920 may be applied to the surface of an object that is capable of being carried in a single hand of a user. Such items include handheld tools, electronic devices, printed materials, and the like. It is contemplated that the appliqué 920 may be applied to the surface of any object for which the locating of an object is desirable. In some instances, the object may be one that is moved within a room such that light emitted by the lighting system 910 is incident thereupon. In some instances, the object may be stationary within a room, and the location of the object may be indicated by the system 900 to someone not familiar with either the object or the location of the object.

In some embodiments, the appliqué 920 may be a sheet of material configured to be applied to the surface of an object 930. The appliqué 920 may be applied to the surface of the object 930 by any means or method as is known in the art, including use of adhesives or glues, spray application, brush application, static cling, magnetism, and the like.

Additionally, the appliqué 920 may be configured to scatter, reflect, and/or diffusively scatter light within a first wavelength range, defined as an appliqué wavelength range. In some embodiments, the appliqué wavelength range may be within a range of frequency of electromagnetic radiation within the visible light spectrum. In some embodiments, the appliqué may be configured to absorb light/electromagnetic radiation outside the appliqué wavelength range, particularly radiation within the visible light spectrum.

The lighting system 910 may comprise a light source 911. The light source 911 may comprise a plurality of light-emitting diodes 912. Additionally, the light source 911 may be configured to emit light. More specifically, the light source 911 may be configured to emit light having a selected spectral power distribution. In some embodiments, the light emitted by the light source 911 may be a polychromatic light. Additionally, the light emitted by the light source 911 may be a white light, or it may be a colored light, e.g. it is perceived as having a color. In some embodiments, the light emitted by the light source may be a white light on the blackbody radiation curve, as is known in the art.

Furthermore, the lighting source 911 may be operable to emit light having varying spectral power distributions. For example, the light source 911 may be operable to emit a first polychromatic light having a first spectral power distribution and a second polychromatic light having a second spectral power distribution. The first spectral power distribution may be different or otherwise not identical to the second spectral power distribution. For example, the first polychromatic light may comprise a maxima within a wavelength range, whereas the second polychromatic light may not include a maxima within the same wavelength range. In some embodiments, the first polychromatic light may include a maxima within the appliqué wavelength range, and the second polychromatic light not include a maxima within the appliqué wavelength range, or may include a minima within the appliqué wavelength range. In such embodiments, both the first and second polychromatic lights may be white lights. Furthermore, the first and second polychromatic lights may have spectral power distributions such that they are not distinguishable by an observer, that is to say they have the same perceived color by an observer. For example, the first and second polychromatic lights may be within a two-step MacAdam ellipse of each other. In some embodiments, the first and second polychromatic lights may be within a three- or four-step MacAdam ellipse of each other. A person having ordinary skill in the art will understand what colors of lights are not distinguishable by an average observer.

While the lighting system 910 of the present embodiment comprises a light source 911, it is contemplated and included within the scope of the invention that the lighting system 910 may comprise any number of light sources, and the lighting system 910 may be operable so as to control the spectral power distribution of light emitted by the light sources comprised thereby individually, as described hereinabove. In such embodiments, the light emitted by the plurality of light sources may combine to form a combine light, which may be a polychromatic light, which may have the spectral power distribution of the first and/or second polychromatic lights as described hereinabove, and which may have any other spectral power distribution as described herein.

When the light source 911 is operated to emit the first polychromatic light, the appliqué 920 may scatter or reflect light within the appliqué wavelength range, and thus the appliqué 920 will be more apparent and distinguishable to an observer. When the light source 911 is operated to emit the second polychromatic light, there will be a substantially lower intensity of light, if any intensity at all, within the appliqué wavelength range. Accordingly, the appliqué 920 will be relatively less apparent to an observer when compared to the appearance of the appliqué 920 when the first polychromatic light is emitted. Accordingly, when it is desirable to facilitate location of the object 930, the first polychromatic light may be emitted by the light source 911. When such facilitation is not desired, the second polychromatic light may be emitted by the light source 911. Additionally, the light source 911 may be operable to alternate emitting the first and second polychromatic lights, such that the appliqué 920 may appear to "flash" by alternatingly reflecting or scattering higher and lower intensities of light within the appliqué wavelength range.

Additionally, in some embodiments, the appliqué 920 may be a first appliqué 920, and the system 900 may further comprise a second appliqué 921. The first appliqué 920 may be attached to a first object 930, and the second appliqué 921 may be attached to a second object 931. Similarly, the appliqué wavelength range associated with the first appliqué 920 may be a first appliqué wavelength range, and the second appliqué 921 may be configured to reflect, scatter, or diffusively scatter electromagnetic radiation within a range within the visible spectrum that is different from the first appliqué wavelength range and absorb light outside that wavelength range, defining a second appliqué wavelength range. Accordingly, the first appliqué 920 may reflect or scatter light within the first appliqué wavelength range, and the second appliqué 921 may reflect or scatter light within the second appliqué wavelength range. Accordingly, the first appliqué 920 may be configured to absorb light outside the first appliqué wavelength range, including light within the second appliqué wavelength range, and the second appliqué 921 may be configured to absorb light outside the second appliqué wavelength range, including light within the first appliqué wavelength range.

Additionally, the light source 911 may be operable to emit first and second polychromatic lights as described hereinabove, with the addition of the first polychromatic light either not comprising a maxima within the second appliqué wavelength range or comprising a minima with the second appliqué wavelength range and the second polychromatic light comprising a maxima within the second appliqué wavelength range. Furthermore, the light source 911 may be operable to emit a third polychromatic light that does not comprise a maxima, or may comprise a minima, within either or both of the first or second appliqué wavelength ranges. Accordingly, when it is desirable to facilitate location of the first object 930, the light source 911 may be operated to emit the first polychromatic light or alternatingly emit the first and third polychromatic lights. When it is desirable to facilitate the location of the second object 931, the light source 911 may be operated to emit the second polychromatic light or alternatingly emit the second and third polychromatic lights. When it is not desirable to facilitate location of either the first or second objects 930, 931, the third polychromatic light may be emitted by the light source 911.

Figure 7:
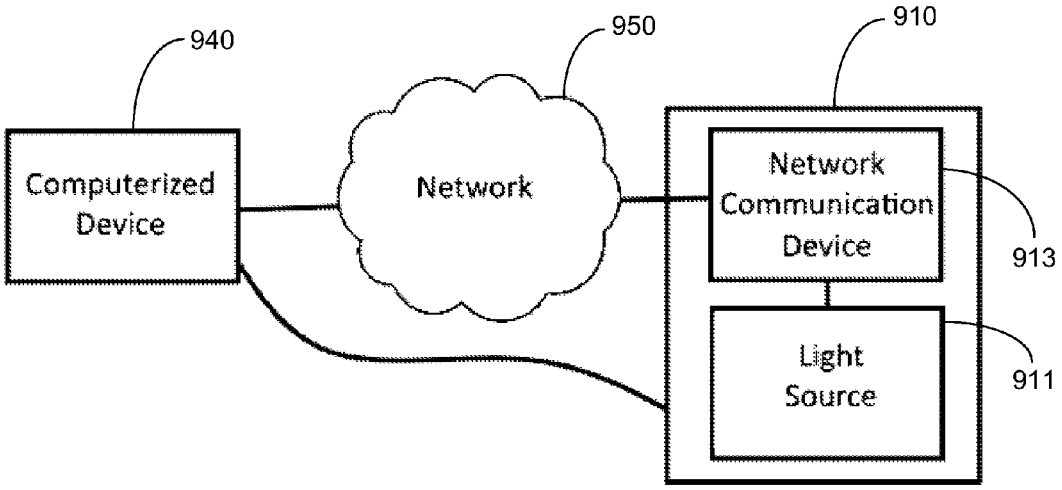
FIG. 7 is a schematic view of a system according to an embodiment of the invention.

Referring now additionally to FIG. 7, additional aspects of the system 900 will now be discussed. In some embodiments, the lighting system 910 may be configured to permit a computerized device 940 to be coupled thereto. The computerized device 940 may be any type of computerized device as is known in the art, including, but not limited to, smart phones, tablet devices, remote controls, personal computers, servers, and the like. Furthermore, the lighting system 910 may be configured to receive instructions from the computerized device 940 and operate the light source 911 responsive to the received instructions. For example, the lighting system 910 may be configured to be selectively operated so as to operate the light source 911 to emit one of the first and second polychromatic lights responsive to one or more instructions received from the computerized device 940. Additionally, the lighting system 910 may be configured to be selectively operated so as to operate the light source 911 to alternatingly emit the first and second polychromatic lights responsive to one or more instructions received from the computerized device 940. It is contemplated and included within the scope of the invention that the lighting system 910, and accordingly the light source 911, may be configured to be operable to emit any light described herein responsive to instructions received from the computerized device 940.

In some embodiments, the lighting system 910 may be operably coupled to the computerized device via a network 950. The network may be any type of network as is known in the art, including, but not limited to, Personal Area Networks, Local Area Networks, and Wide Area Networks, including the Internet. In such embodiments, the lighting system 910 may comprise a network communication device 913 positioned in communication with the light source 911. The network communication device 913 may be configured to connect to the network 950 and communicate with and receive instructions from the computerized device 940 across the network. The network communication device may be any type of wired or wireless communication device as is known in the art, including, but not limited to, Ethernet, USB, Thunderbolt, Wi-Fi, Bluetooth, Zigbee, Rubee, Z-wave, cellular, WiMAX, infrared, and visible light communication devices.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A system for accenting an appliqué comprising:

a lighting system comprising a light source configured to emit polychromatic light; and an appliqué configured to be applied to a surface, the appliqué being configured to at least one of scatter light and reflect light within an appliqué wavelength range;

wherein the light source is operable to emit alternating first and second polychromatic lights, the first polychromatic light comprising a maxima within the appliqué wavelength range and the second polychromatic light not comprising a maxima within the appliqué wavelength range; and wherein each of the first polychromatic light and the second polychromatic light is a white light.

2. The system according to claim 1 wherein the appliqué is configured to absorb light within the visible light spectrum outside the appliqué wavelength range.

3. The system according to claim 1 wherein the appliqué is a sheet of material configured to be applied to the surface.

4. The system according to claim 1 wherein the light source comprises a plurality of light-emitting diodes.

5. The system according to claim 1 wherein the first polychromatic light and the second polychromatic light are within a two-step MacAdam ellipse of each other.

6. The system according to claim 1 wherein the lighting system is configured to permit a computerized device to be operably coupled thereto; and lighting system is configured to be selectively operated by the computerized device to emit one of the first polychromatic light and the second polychromatic light.

7. The system according to claim 6 wherein the lighting system comprises a network communication device that is configured to communicate with the computerized device across a network.

8. The system according to claim 7 wherein the network is at least one of a Personal Area Network, a Local Area Network, and a Wide Area Network, including the Internet.

9. The system according to claim 7 wherein the computerized device is selected from the group consisting of a smartphone, a tablet, a personal computer, and a server.

10. A system for accenting an appliqué comprising:

a lighting system comprising a light source; and a first appliqué configured to be applied to a first surface, the first appliqué comprising a first surface scatter profile;

a second appliqué configured to be applied to a second surface, the second appliqué comprising a second surface scatter profile;

wherein the light emitted by the light source is a polychromatic light;

wherein the first surface scatter profile is configured to at least one of scatter light and reflect light within a first appliqué wavelength range;

wherein the second surface scatter profile is configured to at least one of scatter light and reflect light within a second appliqué wavelength range;

wherein the polychromatic light is at least one of a first polychromatic light having a spectral power distribution comprising a maxima within the first wavelength range and a minima within the second wavelength and a second polychromatic light having a spectral power distribution comprising a maxima within the second wavelength range and a minima within the first wavelength range; and wherein each of the first polychromatic light and the second polychromatic light is a white light.

11. The system according to claim 10 wherein the first appliqué is configured to absorb light within the visible light spectrum outside the first appliqué wavelength range and the second appliqué is configured to absorb light within the visible light spectrum outside the second appliqué wavelength range.

12. The system according to claim 10 wherein the first and second appliqué are sheets of material configured to be applied to a surface.

13. The system according to claim 10 wherein the light source comprises a plurality of light-emitting diodes.

14. The system according to claim 10 wherein the lighting system is configured to permit a computerized device to be operably coupled thereto; and lighting system is configured to be selectively operated by the computerized device to emit one of the first polychromatic light and the second polychromatic light.

15. The system according to claim 14 wherein the lighting system comprises a network communication device that is configured to communicate with the computerized device across a network.

16. The system according to claim 15 wherein the network is at least one of a Personal Area Network, a Local Area Network, and a Wide Area Network, including the Internet.

17. The system according to claim 15 wherein the computerized device is selected from the group consisting of a smartphone, a tablet, a personal computer, and a server.

18. A system for accenting an appliqué comprising:

a lighting system comprising a plurality of light sources configured to emit light that combines to form a combined light; and an appliqué configured to be applied to a surface, the appliqué being configured to at least one of scatter and reflect light within an appliqué wavelength range;

wherein the plurality of light sources are operable to emit alternating first and second combined lights, the first combined light being a polychromatic light comprising a maxima within the appliqué wavelength range and the second combined light being a polychromatic light not comprising a maxima within the appliqué wavelength range; and wherein the first and second combined lights are within a two-step MacAdam ellipse of each other.

* * * * *